US005928826A

United States Patent [19]

Matsuura et al.

[11] Patent Number: 5,928,826

[45] Date of Patent: Jul. 27, 1999

[54] ELECTROSTATIC IMAGE DEVELOPING TONER

[75] Inventors: Yuuji Matsuura; Isao Niimura; Rie Murakami; Mikiko Kanasugi, all of Tsukuba, Japan

[73] Assignee: Hodogaya Chemical Co., Ltd., Kawasaki, Japan

[21] Appl. No.: 09/029,246

[22] PCT Filed: Sep. 5, 1996

[86] PCT No.: PCT/JP96/02514

§ 371 Date: Mar. 4, 1998

§ 102(e) Date: Mar. 4, 1998

[87] PCT Pub. No.: WO97/09655

PCT Pub. Date: Mar. 13, 1997

[30] Foreign Application Priority Data

Sep. 6, 1995 [JP] Japan ..... 7-252010

[51] Int. Cl.[6] ..... G03G 9/097

[52] U.S. Cl. ..... 430/110

[58] Field of Search ..... 430/110, 106

[56] References Cited

U.S. PATENT DOCUMENTS

| | | | |
|---|---|---|---|
| 4,997,740 | 3/1991 | Harnisch et al. | 430/110 |
| 5,370,959 | 12/1994 | Hagiwara et al. | 430/120 |
| 5,500,323 | 3/1996 | Baur et al. | 430/110 |

FOREIGN PATENT DOCUMENTS

| | | | |
|---|---|---|---|
| 0053888 | 6/1982 | European Pat. Off. . | |
| 0575805 | 12/1993 | European Pat. Off. | 430/110 |
| 61-194451 | 8/1986 | Japan | 430/110 |

OTHER PUBLICATIONS

Derwent Abstract 86–268112/41 of Japanese Patent 61–194451 (Pub Aug. 1986).

Hcaplus Abstract AN 1974:449510 of *Arm. Khim. Zh.* (1974), 27(1), 43–9.

*Primary Examiner*—Janis L. Dote

*Attorney, Agent, or Firm*—Oblon, Spivak, McClelland, Maier & Neustadt, P.C.

[57] ABSTRACT

An electrostatic image developing toner, characterized by containing at least a resin, a coloring agent and a compound of the formula (1), (1)

wherein $R_1$ and $R_2$ are respectively independently a $C_1$–$C_{18}$ alkyl group or an aralkyl group which may have a substituent, and X is a halogen ion, an aromatic sulfonic acid ion which may have a substituent or an aromatic carboxylic acid ion which may have a substituent.

3 Claims, No Drawings

ELECTROSTATIC IMAGE DEVELOPING TONER

TECHNICAL FIELD

The present invention relates to an electrophotographic toner containing a certain specific compound.

BACKGROUND ART

In an image-forming process by means of an electrophotographic system, an electrostatic latent image is formed on an inorganic photoconductive material such as selenium, a selenium alloy, cadmium sulfide or amorphous silicon, or on an organic photoconductive material employing a charge-generating material and a charge-transporting material, and the latent image is developed by a toner, then transferred and fixed on a paper sheet or a plastic film to obtain a visible image.

The photoconductive material may be positively electrifiable or negatively electrifiable depending upon its construction. When a printed portion is remained as an electrostatic latent image by exposure, development is conducted by means of an oppositely electrifiable toner. On the other hand, when a printed portion is destaticized for reversal development, development is conducted by means of an equally electrifiable toner. A toner is composed of a binder resin, a coloring agent and other additives. However, in order to impart desired tribocharge properties (such as desired charge up speed, tribocharge level and tribocharge level stability), stability with time and environmental stability, it is common to use a charge-control agent. The properties of the toner will be substantially affected by this charge-control agent.

In a case where a negatively electrifiable photoconductive material is used for development with an oppositely electrifiable toner, or a positively electrifiable photoconductive material is used for reverse development, a positively electrifiable toner is used. In such a case, a positively electrifiable charge-control agent is used.

Further, in a case of a color toner, it is necessary to use a colorless charge-control agent or a charge-control agent with a pale color which does not affect the color of the toner. Such pale-colored or colorless charge-control agents may, for example, be quaternary ammonium chloride compounds disclosed in e.g. Japanese Unexamined Patent Publications No. 119364/1982, No. 9154/1983 and No. 98742/1983.

However, these charge-control agents have various drawbacks such that a charged amount is unstable depending on storing conditions and particularly that a charged amount in a toner which is high at the initial stage of preparation of a developer, is remarkably lowered specially when a temperature and a moisture are high. Further, parahalophenyl carboxylic acid disclosed in Japanese Unexamined Patent Publication No. 186752/1983 has such a drawback that thermostability is poor. Also, the above-mentioned charge-control agents have low electrifying effects or provide oppositely electrifiable toners, or some of them are poor in dispersibility or chemical stability. Thus, none of them has fully satisfactory properties as a charge-control agent.

DISCLOSURE OF INVENTION

It is an object of the present invention to provide a charge-control agent which has a high stability as a colorless compound and a good dispersibility to a binder resin and being free from a deterioration during the preparation of a toner and which is capable of presenting a toner which has a good tribocharge property and which is capable of constantly presenting an image of high image quality under various environmental conditions.

The present inventors have found a colorless stable compound which has excellent dispersibility in a binder resin and which is capable of imparting an excellent tribocharge property to a toner, and have finally invented an excellent toner by using this compound as a charge-control agent.

Namely, the present invention provides an electrostatic image developing toner, characterized by containing at least a resin, a coloring agent and a compound of the formula (1), (1)

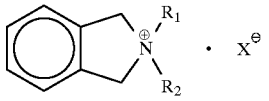

wherein $R_1$ and $R_2$ are respectively independently a $C_1$–$C_{18}$ alkyl group or an aralkyl group which may have a substituent, and X is a halogen ion, an aromatic sulfonic acid ion which may have a substituent or an aromatic carboxylic acid ion which may have a substituent.

In the compound of the formula (1) used as a charge-control agent in the present invention, when $R_1$ and $R_2$ are an aralkyl group which may have a substituent, they are particularly preferably a benzyl group and examples of a substituent include a $C_1$–$C_4$ alkyl group or a halogen atom. When X is an aromatic sulfonic acid ion which may have a substituent, it is particularly preferably a benzenesulfonic acid ion or a naphthalenesulfonic acid ion, and examples of a substituent for the benzenesulfonic acid ion include a $C_1$–$C_{14}$ alkyl group, an amino group, a halogen atom or the like, and examples of a substituent for the naphthalenesulfonic acid ion include a hydroxyl group, an amino group or the like. When X is an aromatic carboxylic acid ion which may have a substituent, it is particularly preferably a benzenecarboxyl acid ion, and examples of a substituent include a hydroxyl group, a $C_1$–$C_4$ alkyl group, a nitro group, a carboxylic group or the like. In any case, the same or different plural substituents may be present.

A quaternary ammonium halide of the formula (1) used in the present invention, can be obtained generally by reacting a o-xylene dihalide and a secondary amine in an alcohol solvent in the presence of a base at a temperature of 60 to 80° C. for 4 to 8 hours. The quaternary ammonium halide thus obtained is dissolved in water or a water-containing alcohol, to which an aqueous solution of an alkali metal salt of carboxylic acid or an alkali metal salt of sulfonic acid or an aqueous solution of an alkali halide is then added, and the resultant mixture is reacted at a temperature of 60 to 80° C. for 4 to 8 hours to obtain various pairs of ion compounds.

The following compounds may be mentioned as specific examples of the compound of the present invention useful as a charge-control agent.

Compound No. 1
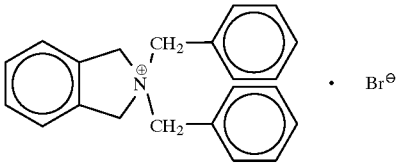
Compound No. 2
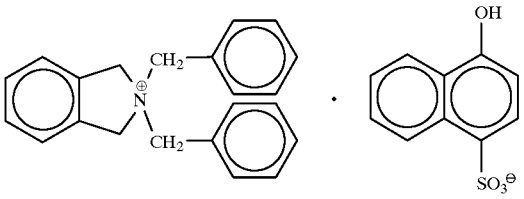
Compound No. 3
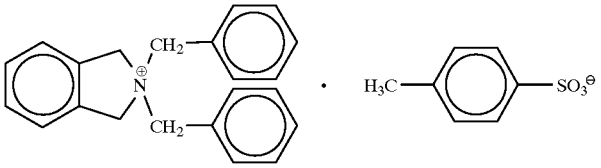
Compound No. 4
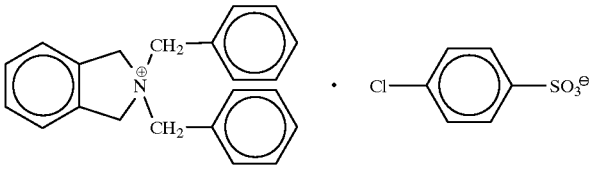
Compound No. 5
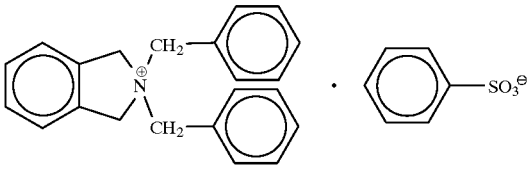
Compound No. 6
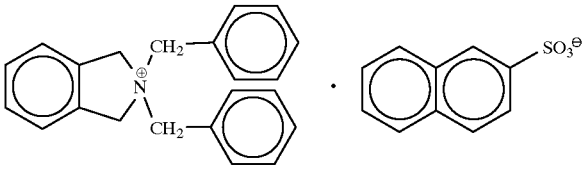
Compound No. 7
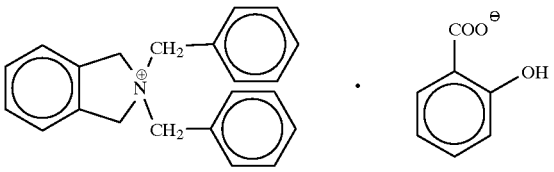

-continued
Compound No. 8
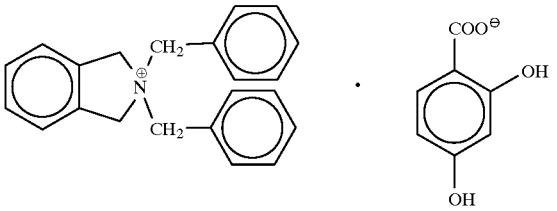
Compound No. 9
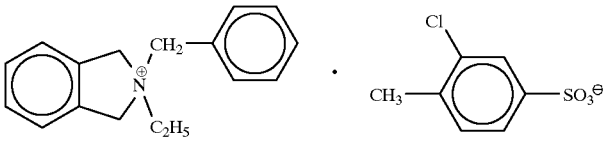
Compound No. 10
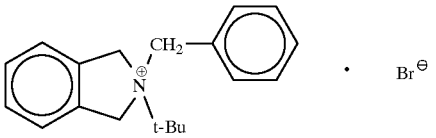
Compound No. 11
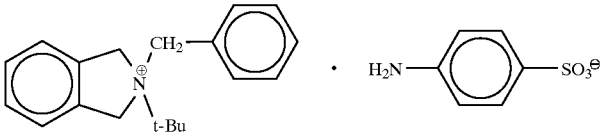
Compound No. 12
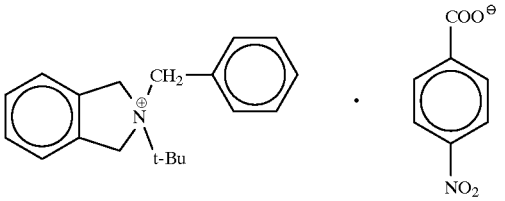
Compound No. 13
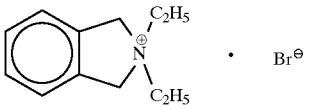
Compound No. 14
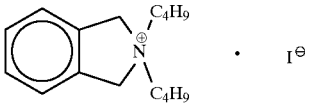
Compound No. 15
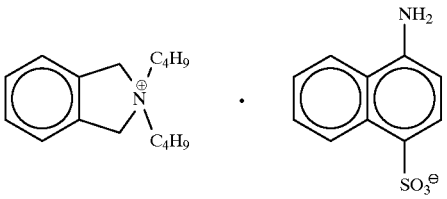

-continued
Compound No. 16
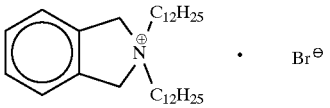
Compound No. 17
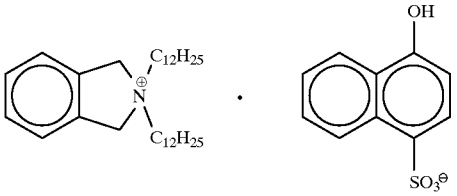
Compound No. 18
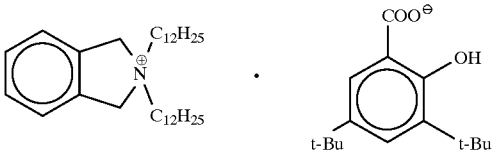
Compound No. 19
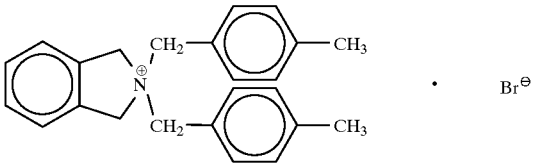
Compound No. 20
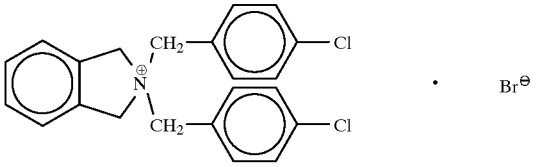
Compound No. 21
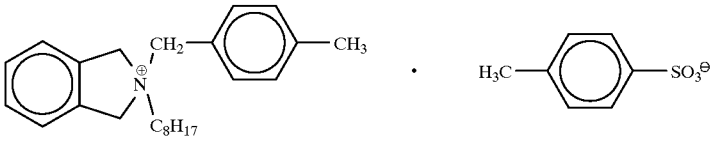
Compound No. 22
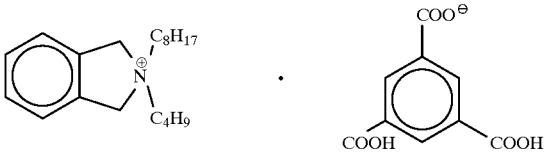
Compound No. 23
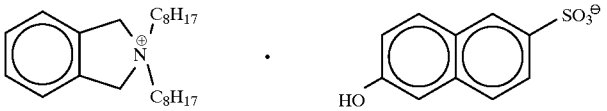

-continued

Compound No. 24

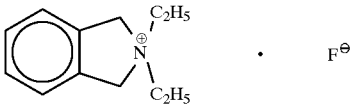

Compound No. 25

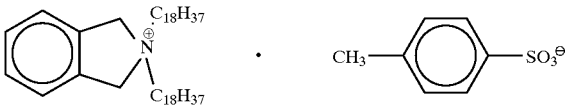

Basically, the toner of the present invention comprises a binder resin, a coloring agent and the compound of the formula (1). As a method for producing the toner of the present invention, there may be mentioned a method wherein a mixture of such starting materials are kneaded by a heat-mixing apparatus while the binder resin is melted, and the mixture is then cooled, followed by rough pulverization, fine pulverization and classification, a method wherein a mixture of such starting materials is dissolved in a solvent and then sprayed to form fine particles, followed by drying and classification, or a method wherein the coloring agent and the compound of the formula (1) are dispersed in suspended monomer particles, followed by polymerization. The toner of the present invention can be produced by any of the above methods.

The toner of the present invention contains a compound of the formula (1) preferably in an amount of from 0.5 to 5 parts by weight to 100 parts by weight of a binder resin.

As the binder resin, a polystyrene, a styrene-methacrylate copolymer, a styrene-propylene copolymer, a styrene-butadiene copolymer, an acrylic resin, a styrene-maleic acid copolymer, an olefin resin, a polyester, an epoxy resin, a polyurethane resin, a polyvinyl butyral, etc., may be used alone or in combination as a mixture.

As the coloring agent, carbon black is commonly used for a black toner. For color toners, the following coloring agents are usually employed. Namely, as a yellow coloring agent, an azo-type organic pigment such as CI pigment yellow 1, CI pigment yellow 5, CI pigment yellow 12 or CI pigment yellow 17, an inorganic pigment such as yellow oshre, or an oil-soluble dye such as CI solvent yellow 2, CI solvent yellow 6, CI solvent yellow 14 or CI solvent yellow 19, may be mentioned. As a magenta coloring agent, an azo pigment such as CI pigment red 57 or CI pigment red 57:1, a xanthene pigment such as CI pigment violet 1 or CI pigment red 81, a thioindigo pigment such as CI pigment red 87, CI vat red 1 or CI pigment violet 38, or an oil-soluble dye such as CI solvent red 19, CI solvent red 49 or CI solvent red 52, may be mentioned. As a cyan coloring agent, a triphenyl methane pigment such as CI pigment blue 1, a phthalocyanine pigment such as CI pigment blue 15 or CI pigment blue 17, or an oil-soluble dye such as CI solvent blue 25, CI solvent blue 40 or CI solvent blue 70, may be mentioned.

Such a coloring agent is used usually in an amount of from 1 to 15 parts by weight, preferably from 3 to 10 parts by weight, per 100 parts by weight of the binder resin.

The toner may further contain various additives such as hydrophobic silica, metal soap, a fluorine-type surfactant, dioctyl phthalate, wax, tin oxide and electrically conductive zinc oxide for the purposes of protecting the photoconductive material or carrier, improving the flowability of the toner, regulating the thermal properties, electrical properties and physical properties, regulating the electrical resistance, regulating the softening point and improving the fixing property.

When the toner of the present invention is used for a two-component developing agent, there may be employed, as a carrier, fine glass beads, iron powder, ferrite powder or a binder-type carrier of resin particles having magnetic particles dispersed therein, or a resin coated carrier having its surface coated with a polyester resin, a fluorine resin, an acrylic resin or a silicone resin. Further, the toner of the present invention exhibits excellent performance when used as a one-component toner.

BEST MODE FOR CARRYING OUT THE INVENTION

Now, the present invention will be described in further detail with reference to Examples. However, it should be understood that the present invention is by no means restricted by such specific Examples. In the following Examples, "parts" means "parts by weight".

EXAMPLE 1

One part of Compound No. 1, 5 parts of carbon black and 94 parts of a styrene-ethylhexyl methacrylate copolymer (monomer ratio=7/3) were kneaded by a heat-mixing apparatus. After cooling, the mixture was roughly pulverized by a hammer mill, then finely pulverized by a jet mill and classified to obtain a black toner of from 10 to 12 $\mu$m. This toner was mixed with an iron powder carrier at a weight ratio of 4:100, and the mixture was shaked, whereby the toner was positively charged, and the tribocharge was measured by a blow off powder charge measuring apparatus and found to be +25 $\mu$c/g. This toner was used to copy an image by a modified commercially available copying machiner whereby copy images with an excellent image quality were obtained not only at the initial stage but also after copying 10,000 sheets.

EXAMPLE 2

One part of Compound No. 2, 5 parts of carbon black and 94 parts of a styrene-ethylhexyl methacrylate copolymer (monomer ratio=7/3) were kneaded by a heat-mixing apparatus. After cooling, the mixture was roughly pulverized by a hammer mill, then finely pulverized by a jet mill and classified to obtain a black toner of from 10 to 12 $\mu$m. This toner was mixed with an iron powder carrier at a weight ratio of 4:100, and the mixture was shaked, whereby the toner was negatively charged, and the tribocharge measured by a blow off powder charge measuring apparatus was +23 μc/g. This toner was used to copy an image by a modified commercially available copying machine, whereby copy images with an excellent image quality were obtained not only at the initial stage but also after copying 10,000 sheets.

EXAMPLE 3

One part of Compound No. 3, 5 parts of Spilon Blue 2BNH as a copper phthalocyanine type oil-soluble dye (product of Hodogaya Chemical Co., Ltd.) and 94 parts of a styrene-butyl methacrylate copolymer (monomer ratio=8/2) were kneaded by a heat-mixing apparatus. After cooling, the mixture was roughly pulverized by a hammer mill, then finely pulverized by a jet mill and classified to obtain a blue toner of from 10 to 12 μm. This toner was mixed with an iron powder carrier at a weight ratio of 4:100, and the mixture was shaked, whereby the toner was positively charged, and the tribocharge measured by a blow off powder charge measuring apparatus was +18 μc/g. This toner was used to copy an image by a modified commercially available copying machine, whereby copy images with an excellent image quality were obtained not only at the initial stage but also after copying 10,000 sheets.

EXAMPLE 4

One part of Compound No. 4, 5 parts of carbon black and 94 parts of a styrene-ethylhexyl methacrylate copolymer (monomer ratio=7/3) were kneaded by a heat-mixing apparatus. After cooling, the mixture was roughly pulverized by a hammer mill, then finely pulverized by a jet mill and classified to obtain a black toner of from 10 to 12 μm. This toner was mixed with a silicone resin coated carrier at a weight ratio of 4:100, and the mixture was shaked, whereby the toner was positively charged, and the tribocharge measured by a blow off powder charge measuring apparatus was +15 μc/g. This toner was used to copy an image by a modified commercially available copying machine, whereby copy images with an excellent image quality were obtained not only at the initial stage but also after copying 10,000 sheets.

EXAMPLE 5

One part of Compound No. 1, 40 parts of magnetic iron powder and 59 parts of a styrene-ethylhexyl methacrylate copolymer (monomer ratio=7/3) were kneaded by a heat-mixing apparatus. After cooling, the mixture was roughly pulverized by a hammer mill, then finely pulverized by a jet mill and classified to obtain a black toner of from 10 to 12 μm. This toner was mixed with a ferrite carrier, and the mixture was shaked, whereby the toner was positively charged. This toner was used to copy an image by a modified commercially available copying machine for one-component toner, whereby copy images with an excellent image quality were obtained.

EXAMPLES 6 to 10

Experiments were conducted in the same manner as in Example 1 except that the compounds as identified in Table 1 were used instead of Compound No. 1 in Example 1, and the results are shown in Table 1.

TABLE 1

| Example No. | Compound No. | Tribo-charge of the toner (+μc/g) | Image quality: Initial | Image quality: After copying 10,000 sheets |
|---|---|---|---|---|
| 6 | Compound No. 7 | 21 | Clear | Clear |
| 7 | Compound No. 10 | 20 | Clear | Clear |
| 8 | Compound No. 17 | 12 | Clear | Clear |
| 9 | Compound No. 18 | 13 | Clear | Clear |
| 10 | Compound No. 23 | 10 | Clear | Clear |

INDUSTRIAL APPLICABILITY

The toner of the present invention is an excellent electrophotographic toner containing, as a positively electrifiable charge-control agent, a colorless compound containing no metal, having such a good compatibility with a resin as to be uniformly dispersed and also having excellent positive electrifiability, electrification build up property, stability with time and environmental stability.

We claim:

1. An electrostatic image developing toner, characterized by containing at least a resin, a coloring agent and a compound of the formula (1), (1)

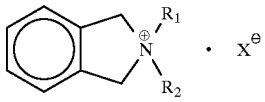

wherein $R_1$ and $R_2$ are respectively independently a $C_1$–$C_{18}$ alkyl group or an aralkyl group which may have a substituent, and X is a halogen ion, an aromatic sulfonic acid ion which may have a substituent or an aromatic carboxylic acid ion which may have a substituent.

2. The electrostatic image developing toner according to claim 1, which comprises 100 parts by weight of a binder resin, from 1 to 15 parts by weight of a coloring agent and from 0.5 to 5 parts by weight of a compound of the formula (1).

3. The electrostatic image developing toner according to claim 1, wherein the compound of the formula (1) is one of the following compounds:

Compound No. 1
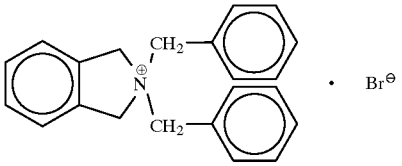
Compound No. 2
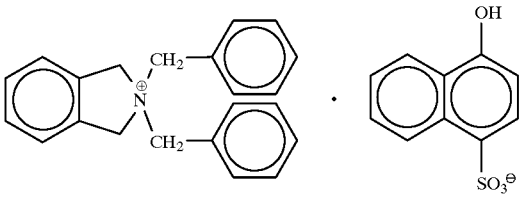
Compound No. 3
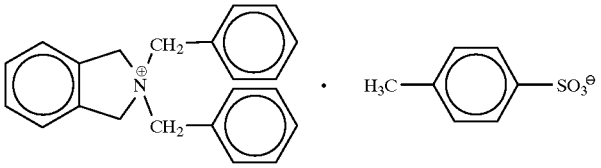
Compound No. 4
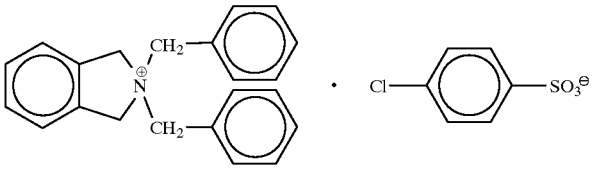
Compound No. 5
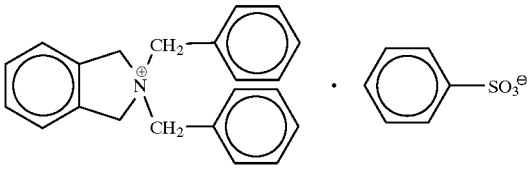
Compound No. 6
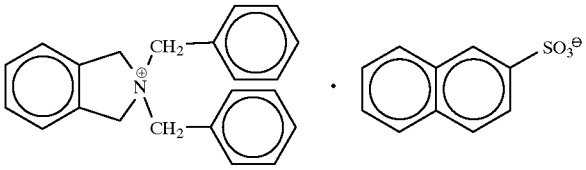
Compound No. 7
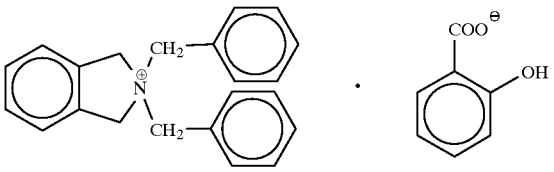

-continued
Compound No. 8
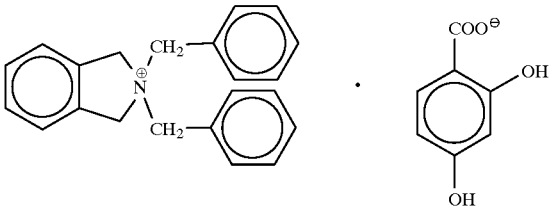
Compound No. 9
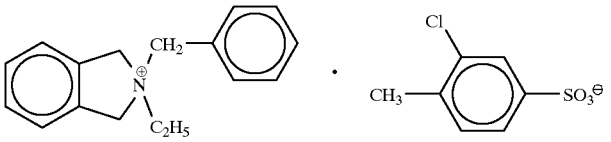
Compound No. 10
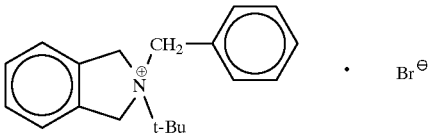
Compound No. 11
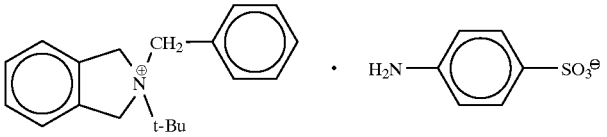
Compound No. 12
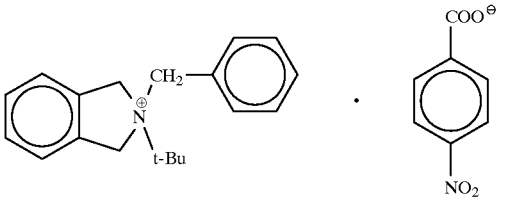
Compound No. 13
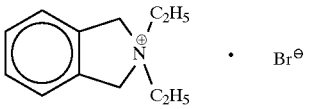
Compound No. 14
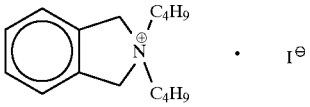
Compound No. 15
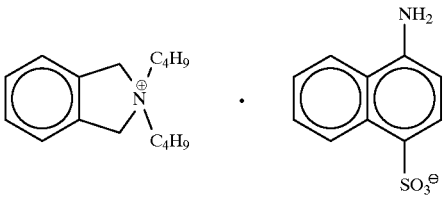

-continued
Compound No. 16
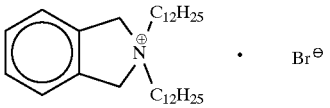
Compound No. 17
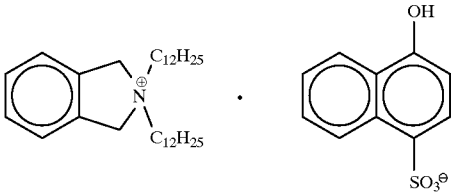
Compound No. 18
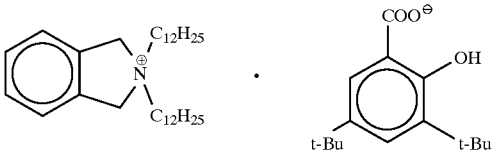
Compound No. 19
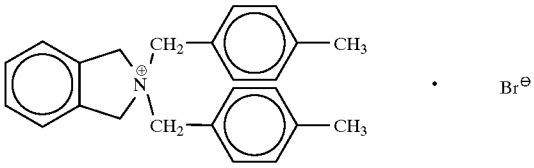
Compound No. 20
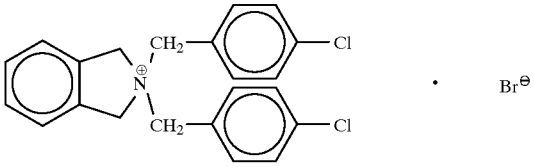
Compound No. 21
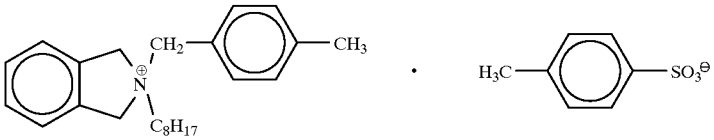
Compound No. 22
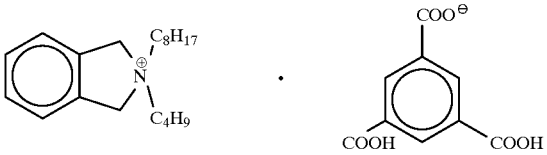
Compound No. 23
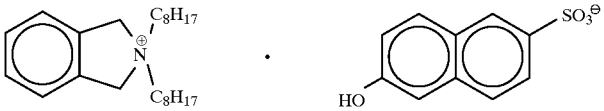

-continued
Compound No. 24
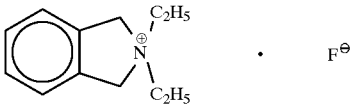
Compound No. 25
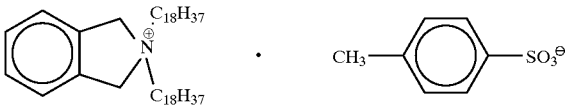
15
* * * * *